United States Patent [19]

DuPont, Jr. et al.

[11] 4,038,905

[45] Aug. 2, 1977

[54] COMPRESSIBLE FLUID RECOIL SYSTEM

[75] Inventors: Achiel M. DuPont, Jr.; J. Burnett Moody, both of Rock Island, Ill.; Roger L. Newlon, Davenport, Iowa

[73] Assignee: The United States of America as represented by the Secretary of the Army, Washington, D.C.

[21] Appl. No.: 681,353

[22] Filed: Apr. 29, 1976

[51] Int. Cl.[2] ..... F41F 19/10

[52] U.S. Cl. ..... 89/43 R; 188/312

[58] Field of Search ..... 89/43 R, 177; 188/268, 188/312, 313, 316

[56] References Cited

U.S. PATENT DOCUMENTS

| | | | |
|---|---|---|---|
| 2,595,239 | 5/1952 | Gay | 188/316 |
| 2,715,856 | 8/1955 | Kramer et al. | 89/43 R |
| 3,053,526 | 9/1962 | Kendall | 188/268 |
| 3,368,697 | 2/1968 | Carlson | 188/312 |
| 3,722,640 | 3/1973 | Taylor | 188/316 |

*Primary Examiner*—Stephen C. Bentley

*Attorney, Agent, or Firm*—Nathan Edelberg; Harold H. Card, Jr.; Robert O. Richardson

[57] ABSTRACT

This invention relates to new and improved methods and apparatus for effectuating recoil and counterrecoil movement of the gun tube of a weapon system wherein a movable piston sleeve concentric with and movably connected to the gun tube defines a pressurizable compressible fluid chamber with the stationary cradle of the weapon system and carries a piston head which separates the chamber into two compartments, a muzzle compartment and a breech compartment, and which defines with the interior wall of the cradle an annular fluid throttling orifice to cause energy dissipation during movement of the piston. The piston sleeve is separated by the piston head into two sections of different diameters, the larger diameter section being located on the muzzle compartment side of the chamber so that compressed fluid, at the termination of the recoil cycle acting on the piston, may initiate counterrecoil movement of the piston and gun tube as a result of the force differential in said compartments.

Near the end of the counterrecoil cycle, improved buffer means of this invention act to dampen the velocity of the piston to prevent the moving parts from slamming into battery position against the stationary parts.

Improved seal means are also utilized to minimize the possibility of air intake into the muzzle compartment to prevent cavitation of the fluid upon initiation of the recoil cycle.

5 Claims, 5 Drawing Figures

FIG. 2
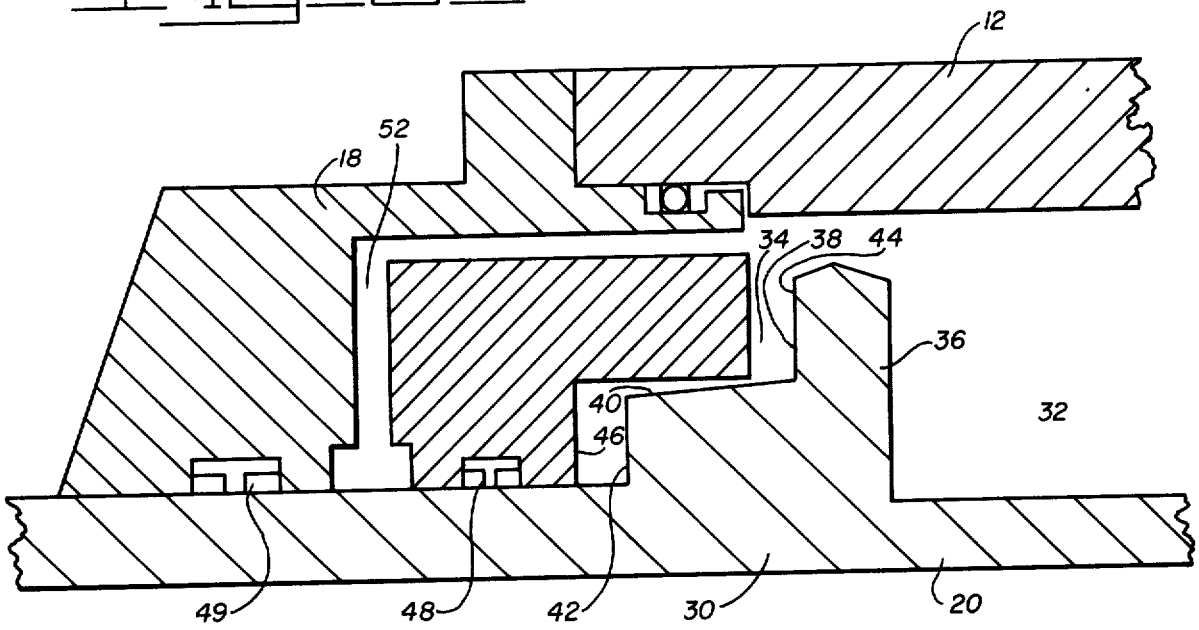
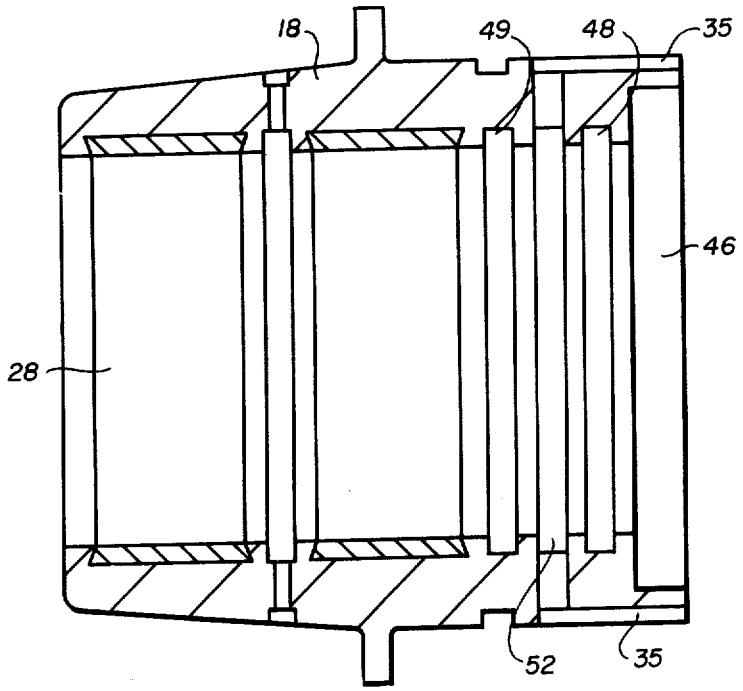
FIG. 3

COMPRESSIBLE FLUID RECOIL SYSTEM

BACKGROUND OF THE INVENTION

The invention described herein may be manufactured and/or used by or for the Government for governmental purposes without the payment of any royalty thereon.

This invention relates to cannon recoil systems and is particularly adaptable for use in tank cannon recoil systems which require that the cannon recoil travel be of the order only of 7 to 14 inches. The generalized operation cycle for a conventional tank cannon recoil system consists of two primary states or cycles, recoil and counterrecoil.

Conventional recoil-counterrecoil systems used in tank weapon systems comprise the cannon or gun tube assembly and the concentric, recoil-counterrecoil piston assembly. A control orifice is employed to throttle the fluid during recoil to bring the recoiling parts to rest by dissipation of recoil energy. During recoil, a large helical compression spring of the recoil piston assembly is compressed to provide storage of energy generated during recoil in an amount sufficient to return the recoiling parts to the in-firing position, i.e. counterrecoil. A buffer mechanism is also required in the recoil system having a sealed inertial valve movable with the cannon and piston to reduce the velocity of the recoiling parts during movement of the recoiling parts to prevent the counterrecoiling parts from slamming into the in-battery position.

It will be appreciated that the large size compression spring requires special tools for achieving the desired compression force. Also, the large size spring has by experience a high failure or short use rate necessitating use of special tools, such as spring compression fixtures, for assembly and disassembly.

In other weapon systems, auxiliary recuperator assemblies employing liquid or gas floating piston and cylinder arrangements have been utilized to accommodate recoil-counterrecoil conditions. In these systems the piston and cylinder arrangement involves structural components for meeting the demands of cycling the fluid in the cylinder from both sides of the piston under dynamic firing conditions. These prior art auxiliary recuperator assemblies require precision valving and manufacture, settings, and maintenance to assure adequate performance of the weapon systems over the use life. These manufacturing and maintenance requirements dictate that the assembly, disassembly and repair be performed at a higher maintenance eschelon level than field.

SUMMARY OF THE INVENTION

By utilization of the present invention, these problems and difficulties, among others, of the prior art are substantially overcome by the provision of a recoil-counterrecoil system particularly adapted for use with a tank cannon system which eliminate the requirement for a large size compression spring utilized for counterrecoil purposes and also eliminates the precision machining and maintenance problems of the prior art recuperator assemblies.

Basically, the present invention consists of only two parts — a piston and a cylinder, the piston having a particularly adapted annular head arrangement spaced from the cylinder interior wall to provide a throttling effect during recoil of the cannon for energy dissipation, while the piston configuration also provides means for automatic counterrecoil and whose function may be characterized as producing a controlled resisting function which is a specific force vs time function, i.e., is not an instantaneous spike-loading function. Thus, the configuration of the present invention permits operation thereof in weapon systems having different performance characteristics in response to movement of the piston during recoil to store sufficient energy generated in a compressible fluid in the cylinder by movement of the head during recoil whereby the energy thus stored is utilized to automatically return the piston and effect counterrecoil of the gun to the firing position upon termination of the recoil cycle.

BRIEF DESCRIPTION OF THE DRAWINGS

FIG. 2 is an enlarged diagramatic sketch illustrating the coacting relationship of the piston head and buffer of the present invention.

FIG. 3 is a side view in section illustrating the buffer-seal means of the present invention.

DESCRIPTION OF A PREFERRED EMBODIMENT

Figure 1:
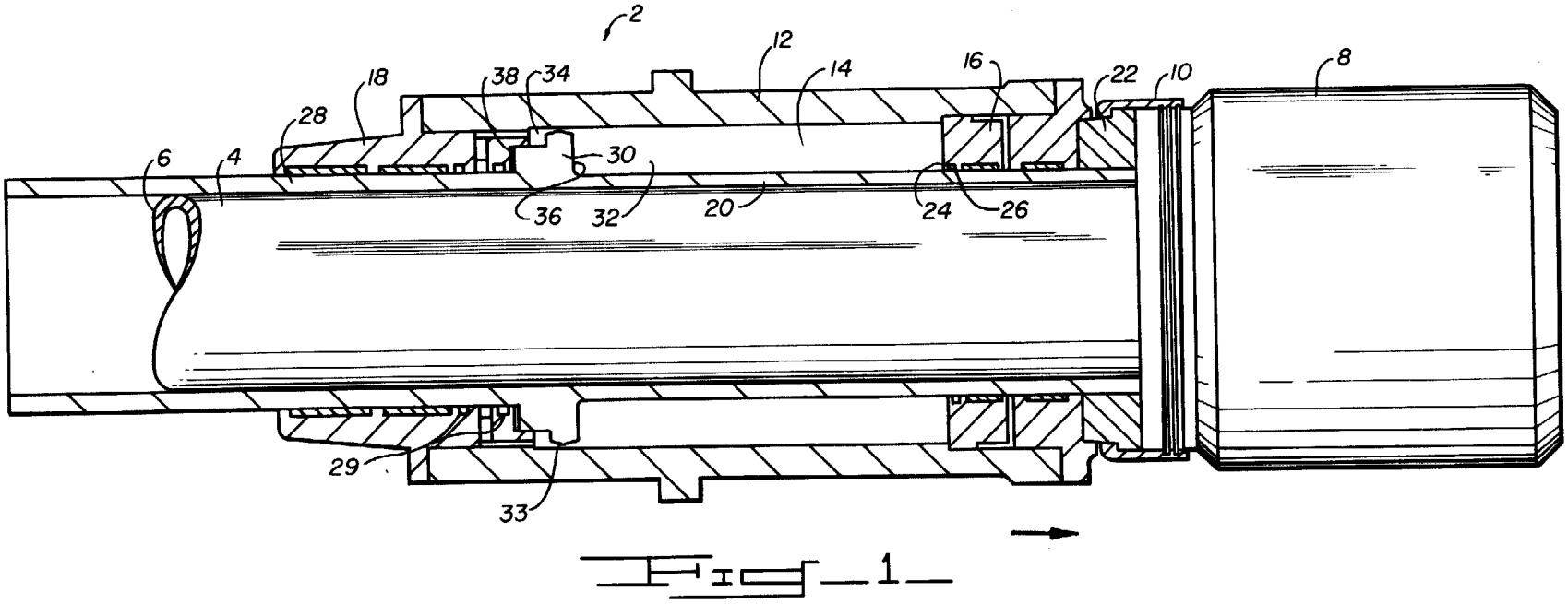
FIG. 1 is a side view of the present invention partially sectioned to facilitate explanation.

Referring to FIG. 1 there is shown a gun mount generally indicated by the numeral 2 including a gun tube 4 having a muzzle end 6 and a breech end 8. The breech 8 is secured to the gun tube by a breech collar 10. The gun tube 4 is movable within a stationary cradle 12 which defines therebetween a concentric pressurizable chamber 14 closed at the breech end 8 by a seal retainer means 16 and at the muzzle end by a buffer seal retainer means 18.

Carried for movement by the gun tube 4 in the chamber 14 is piston means 20 constructed in the form of a cylindrical sleeve. The piston 20 circumscribes and is concentric with the gun tube 4 and has a diameter on the muzzle side which is greater than its diameter on the breech side. In a preferred design the diameter difference was approximately 2.0 inches operating at a maximum operating pressure of 6000 psi. The piston 20 extends on the breech side 8 through an aperture 24 found in the seal retainer means 16 which includes seals 26 and is connected to the breech 8 as by threading. The piston section of larger diameter extends through an aperture 28 in the buffer seal retainer means 18 which also includes seals 29.

Separating the chamber 14 into a breech compartment 32 and a muzzle compartment 34 is a stepped piston head 30. The stepped annular piston head 30 is sized so that the periphery of the head is spaced from the interior wall of the cradle 12 a predetermined distance to define with the interior wall of the cradle an annular orifice 33 for purposes explained hereinafter. The stepped head 30 is also sloped in cross section as illustrated in FIG. 2 as at 40. The head 30 separates the piston sleeve into the different diameter sections, when assembled, and in its nonfiring or static condition or state the piston head 30 is positioned adjacent the muzzle seal retainer means 18 for reasons which become apparent hereinafter. Thus, due to the differential of piston section diameters on opposite sides of the head, the area of the piston sleeve facing the breech compartment 32 is less than the area of the piston sleeve facing the muzzle compartment 34, as seen in FIG. 1.

An appropriate compressible liquid such as a silicone bore material sold under the trade name "Dow Corning 10CS Silicon Fluid" is contained in the chamber under pressure 14.

Referring now to FIG. 2, the buffer arrangement comprises the front wall 42, sloped section 40 and front wall 44 of the piston head 30, and an annular recess 46 formed in the buffer-seal retainer means 18.

Figure 4:
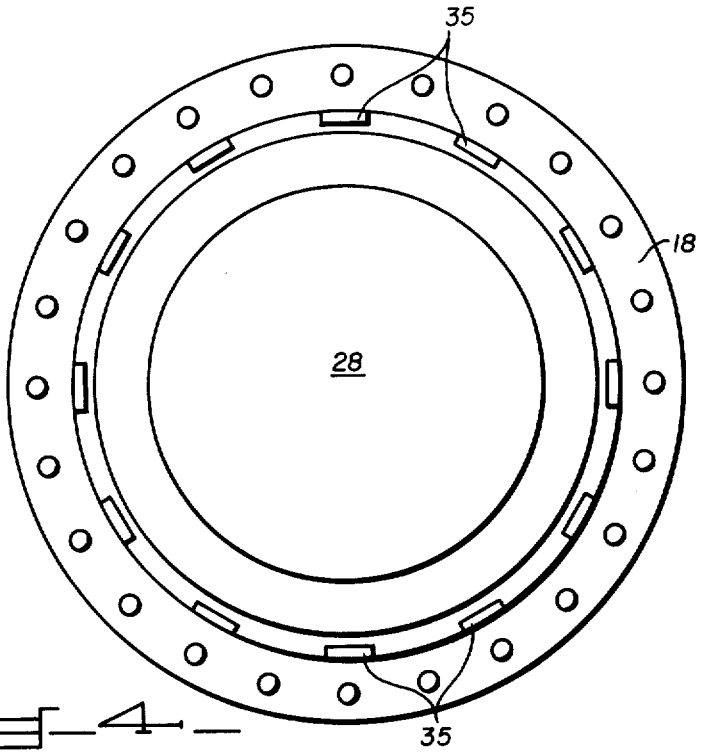
FIG. 4 is a front view of the buffer seal.
Figure 5:
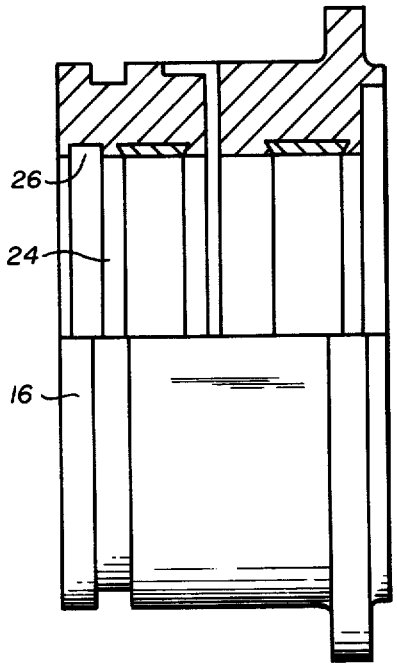
FIG. 5 is a side view in partial section illustrating the seal retainer adjacent the gun tube breech.

The buffer seal retainer means 18 includes for sealing purposes two seals, 48 and 49 preferably of the labyrinth type, separated by an annular channel 52 machined in the seal retainer means (FIG. 2). Twelve spaced bypass channels 35 (FIG. 4) are formed in the seal retainer means 18 to communicate the buffer channel 52 with the muzzle compartment 34.

In operation upon firing of the weapon, the gun tube and piston 20 move in the recoil direction of the arrow in FIG. 1. Upon moving in recoil, the piston head compresses the fluid in the breech chamber 32. Some of the energy generated by the piston during its recoil movement is dissipated through the cradle 12 by throttling of the fluid through the orifice 33 defined between the piston head 30 and interior wall of the cradle 12.

When the recoiling parts come to rest at the end of the recoil cycle, a pressure due to compression exists in the chamber. Dynamically as the piston reaches the end of its recoil cycle, its movement terminates temporarily. Since the area of the piston on the breech compartment side is larger than the area of the piston on the muzzle compartment side, a pressure force imbalance exists in the chamber 14 which causes the compressed fluid to act on the breech side of the piston head 30 to initiate a return counterrecoil movement of the piston.

At this moment in time the pressure induced by compression of the fluid in the chamber on both sides of the chamber is equal but greater than the pressure at the beginning of the recoil cycle. However, because the area of the piston on the breech side of the head is greater than the area of the piston on the muzzle side due to the differential piston section diameters, the pressure force in the breech compartment is greater than the pressure force in the muzzle compartment of the chamber. In the preferred design a pressure differential was generated in the breech compartment of approximately 12,000 lbs. which the system pressure was 6,000 psi. The pressure force differential produces a resultant pressure force acting on the piston head in the direction of the muzzle compartment. Consequently, the resultant force initiates movement of the piston towards the muzzle end, i.e., counterrecoil movement. The counterrecoil pressure force accelerates the recoiling parts, i.e., gun tube and piston, towards their original in-battery position. During counterrecoil movement the overall chamber pressure reduces over time and at the termination of counterrecoil is substantially equivalent to the original chamber pressure at the initiation of the recoil cycle. The pressure reduction results from the fact that, during counterrecoil movement, portions of the larger diameter piston section on the muzzle side of the piston head are displaced from the chamber 32 while portions of the smaller diameter piston section on the breech side of the piston head are entering the chamber 32. In addition, energy (heat) is being dissipated by virtue of the throttling effect on the fluid caused by movement of the piston head during counterrecoil through the fluid relative to the interior wall of the cradle i.e., the head-cradle orifice effect. Moreover, the velocity of the moving parts during counterrecoil movement is reduced substantially because the only orifice area available for fluid flow between the compartments is the orifice 33 defined by the piston head 30 and interior wall of the cradle 12.

In order to prevent the moving parts from slamming into the stationary parts at the end of the counterrecoil cycle, the buffer means are provided. In general, the buffer means include the configurated piston head 30 and the recess 46 in the buffer seal retaining means 18 which substantially reduce the velocity of the moving parts during the last few inches of counterrecoil travel. As the sloped portion 40 of the piston head 30 enters the annular recess 46 of the seal retainer means 18, a damping effect is generated therebetween which results in the reduction in velocity of the moving parts and thereby returns the gun tube and piston to the in battery position ready for reloading without substantial impact between the moving and stationary parts of the assembly.

The seal retainer means 18 of the present invention is provided primarily for prevention of air intake into the chamber 14 by the minimization of deleterious cavitation effects in the muzzle compartment upon initiation of the recoil cycle.

The fluid volume in the channel 52 and between the seals 48 and 49 is pre-pressurized by the initial fluid change in the chamber. In the preferred design, the bypass channels 35, acting as pressure control orifices were sized to maintain a minimum pressure of 1,000 psi (in the muzzle compartment) during recoil where the chamber 14 characteristics were designed to provide compression of the fluid during recoil with a maximum working chamber pressure of 6,000 psig. Should cavitation pressure levels be approached in the muzzle compartment at the initiation of recoil, the fluid held at 1,000 psi in the bypass channels 35 will attempt to flow into the buffer channel 52 past the inside seal 48. Since the volume of fluid at 1,000 psi is larger than the volume of the buffer channel 52 the amount of flow necessary to fill the buffer channel 52 will not cause an appreciable pressure drop in the fluid volume ahead of the piston and thereby effective sealing by the outer seal 49 will be maintained to prevent air intake into the muzzle channel from atmosphere, thus preventing cavitation in the muzzle compartment at the initiation of recoil.

It will be appreciated that utilization of the present invention provides a simply constructed recoil-counterrecoil mechanism for a weapon system with automatic counterrecoil characteristics, which has an improved counterrecoil buffer arrangement and an anti-cavitation seal means.

It is to be understood that it is not desired that the invention be limited to the exact details of construction shown and described, for modifications will occur to a person skilled in the art.

I claim:

1. In a weapon system including a movable gun tube having a breech and muzzle and having recoil and counterrecoil operating functions and a stationary gun mount cradle concentric with the gun tube, the improvement comprising:

a pressure chamber having end walls formed concentrically between said gun tube and cradle, a movable cylindrical sleeve piston having sections of different diameters in said chamber concentric with said gun tube and movably extending through said chamber end walls, means sealing said end walls to permit pressurization of said chamber, means connecting said gun tube and piston for movement together, a circular stepped head in said chamber carried by and circumscribing said piston and separating said chamber into a breech compartment and a muzzle compartment, the larger diameter section of said piston being located in said muzzle compartment, said head being of lesser cross section on the muzzle compartment side of the chamber, said cradle and head being spaced to define therebetween an annular orifice to throttle liquid passage between said compartments, buffer means facing into the muzzle compartment actable with the smaller diameter portion of said piston head to damp movement of said piston near the end of counterrecoil movement, and a pressurizable compressible liquid in said chamber, whereby, during recoil movement of said piston, said piston compresses liquid in the chamber by reducing the volume thereof and, at the end of the recoil movement, the compressed liquid force acting on the larger area of the smaller diameter section of the piston produces a counterrecoil force for returning the piston and gun tube to their battery positions, said seal means including a retainer member forming the end wall of the muzzle compartment, said buffer means including spaced grooves in the seal retainer for receiving the seals, and a chamber in said seal retainer located between said seals and in fluid communication with said muzzle compartment, said retainer chamber being sized relative to the muzzle compartment to maintain a pressure greater than the pressure in the muzzle compartment upon initiation of the recoil cycle and greater than atmospheric pressure thereby to prevent air intake into the muzzle compartment.

2. The system of claim 1 wherein said piston head section of smaller diameter is sloped in cross section and said seal means includes a seal retainer having a recess which cooperates with said sloped piston head section to produce said damping effect near the end of the counterrecoil cycle.

3. The system of claim 1 wherein an aperture is formed in said retainer to permit reciprocal movement of the piston therethrough and secondary seal means prevents fluid leakage from the chamber through said aperture.

4. The system of claim 3 wherein said seal means includes a second retainer member forming the end wall of the breech compartment, an aperture formed in the retainer to permit reciprocal movement of the piston therethrough and secondary seal means for preventing leakage from the chamber through said aperture.

5. The system of claim 1 wherein said seal retainer is circular, said seal retainer chamber is an annular channel and a plurality of spaced bypass channels communicate the seal retainer channel and the muzzle compartment.

* * * * *